United States Patent [19]

Roddy

[11] Patent Number: 5,046,981

[45] Date of Patent: Sep. 10, 1991

[54] TOY VEHICLE WITH REMOTELY DRIVEN SPEAKER AND PLURAL BODIES

[76] Inventor: Kenneth A. Roddy, 15322 E. Ritter Cir., Houston, Tex. 77071

[21] Appl. No.: 495,843

[22] Filed: Mar. 19, 1990

[51] Int. Cl.[5] ..... A63H 5/00; A63H 17/00; A63H 17/34; A63H 3/33

[52] U.S. Cl. ..... 446/81; 446/94; 446/302; 446/409; 369/31; 369/64

[58] Field of Search ..... 446/81, 71, 93, 94, 446/297, 299, 302, 397, 404, 408, 409, 411, 414, 431, 465, 456, 454, 484; 369/31, 63, 64, 70, 1, 2, 6, 7, 10

[56] References Cited

U.S. PATENT DOCUMENTS

| | | | |
|---|---|---|---|
| 3,943,564 | 3/1976 | Tushinsky | 369/6 |
| 4,186,519 | 2/1980 | Repka | 446/408 |
| 4,219,962 | 9/1980 | Dankman et al. | 446/409 |
| 4,406,085 | 9/1983 | Rhodes | 446/456 |
| 4,889,516 | 12/1989 | Auer et al. | 446/470 X |

FOREIGN PATENT DOCUMENTS

| | | | |
|---|---|---|---|
| 0036797 | 9/1981 | European Pat. Off. | 446/299 |
| 3009040 | 9/1981 | Fed. Rep. of Germany | 446/456 |
| 2625446 | 7/1989 | France | 446/409 |
| 506842 | 6/1939 | United Kingdom | 446/94 |
| 1357517 | 6/1974 | United Kingdom | 446/94 |

*Primary Examiner*—Robert A. Hafer
*Assistant Examiner*—D. Neal Muir
*Attorney, Agent, or Firm*—Kenneth A. Roddy

[57] ABSTRACT

A toy vehicle having a sound system is releasably connected to a sound source such as a portable radio and/or tape player to play actual radio transmissions or prerecorded audio tapes. The toy vehicle will simulate the radio or tape player of an actual vehicle and will allow a child to select any type of music or recorded sounds to be reproduced on the vehicle sound system. The vehicle is provided with an audio mini-jack coupled to one or more small loudspeakers mounted in the vehicle. The portable radio and/or tape player can be clipped to the child's belt or clothing and the toy vehicle can be played with either as an ordinary toy vehicle or as a sound producing vehicle. The vehicle and sound system may be produced in connectable module form whereby the sound system module can be selectively connected to other vehicle components to produce vehicles of various configurations and designs.

10 Claims, 2 Drawing Sheets

TOY VEHICLE WITH REMOTELY DRIVEN SPEAKER AND PLURAL BODIES

BACKGROUND OF THE INVENTION

1. Field of the Invention

This invention relates generally to toy vehicles, and more particularly to a toy vehicle having a sound system which can be connected to an existing sound source such as a portable radio and/or tape player to play a variety of actual radio transmissions or prerecorded audio tapes through the sound system of the toy vehicle.

2. Brief Description of the Prior Art

There are known toy vehicles which will produce various sounds. Most of which are provided with an I.C. chip which will produce a sound simulative of the vehicle in which it is housed. For example, the vehicle will make a sound such as an emergency vehicle siren. Other vehicles will make sounds which simulate the engine speed when driving, shifting gears, and honking the horn, etc. Airplanes and helicopters have been recently developed which will simulate the sound made when diving, climbing, or shooting.

The present invention is distinguished over the prior art in general, and these patents in particular by a toy vehicle having a sound system which is releasably connected to a sound source such as a portable radio and/or tape player to play actual radio transmissions o prerecorded audio tapes. The toy vehicle will simulate the radio or tape player of an actual vehicle and will allow a child to select any type of music or recorded sounds to be reproduced on the vehicle sound system. The vehicle is provided with an audio mini-jack coupled to one or more small loudspeakers mounted in the vehicle. The portable radio and/or tape player can be clipped to the child's belt or clothing and the toy vehicle can be played with either as an ordinary toy vehicle or as a sound producing vehicle. The vehicle and sound system may be produced in connectable module form whereby the sound system module can be selectively connected to other vehicle components to produce vehicles of various configurations and designs.

SUMMARY OF THE INVENTION

It is therefore an object of the present invention to provide a toy vehicle having a sound system which can be connected an existing sound source such as a portable radio and/or tape player to play actual radio transmissions and music or prerecorded audio tapes through the sound system of the toy vehicle.

It is another object of this invention to provide a toy vehicle having a sound system which will simulate an actual vehicle radio or tape player.

Another object of this invention is to provide a toy vehicle having a sound system which will allow a child to select any type of music or recorded sounds to be reproduced on the vehicle sound system.

Another object of this invention is to provide a toy vehicle having a sound system which allows the vehicle to be connected to commercially available portable radios and/or tape players.

Another object of this invention is to provide a toy vehicle having a sound system which may be played with either as an ordinary toy vehicle or as a sound producing vehicle.

Another object of this invention is to provide a toy vehicle in modular form including a sound system module resembling one portion of a vehicle which can be selectively connected to other modular vehicle portions to produce vehicles of various configurations and designs.

A further object of this invention is to provide a toy vehicle having a sound system which will simulate vehicles known as "boom cars" which have loud playing music to attract attention.

A still further object of this invention is to provide a toy vehicle having a sound system which is simple in design and construction, economical to manufacture, and rugged and reliable in use.

Other objects of the invention will become apparent from time to time throughout the specification and claims as hereinafter related.

The above noted objects and other objects of the invention are accomplished by a toy vehicle having a sound system which is releasably connected to a sound source such as a portable radio and/or tape player to play actual radio transmissions or prerecorded audio tapes. The toy vehicle will simulate the radio or tape player of an actual vehicle and will allow a child to select any type of music or recorded sounds to be reproduced on the vehicle sound system. The vehicle is provided with an audio mini-jack coupled to one or more small loudspeakers mounted in the vehicle. The portable radio and/or tape player can be clipped to the child's belt or clothing and the toy vehicle can be played with either as an ordinary toy vehicle or as a sound producing vehicle. The vehicle and sound system may be produced in connectable module form whereby the sound system module can be selectively connected to other vehicle components to produce vehicles of various configurations and designs.

DESCRIPTION OF THE PREFERRED EMBODIMENT

Figure 1:
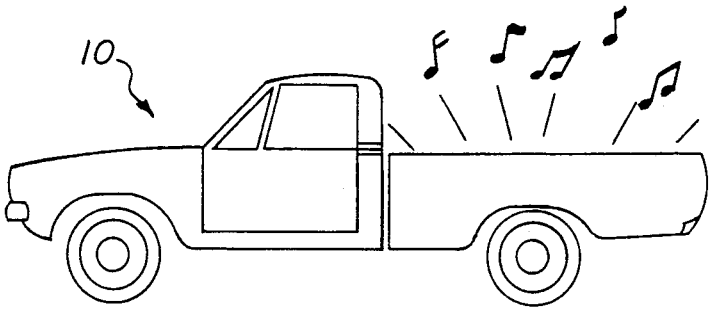
FIG. 1 is a side elevation of a toy vehicle in the form of a pickup truck having a sound system in accordance with the present invention.
Figure 2:
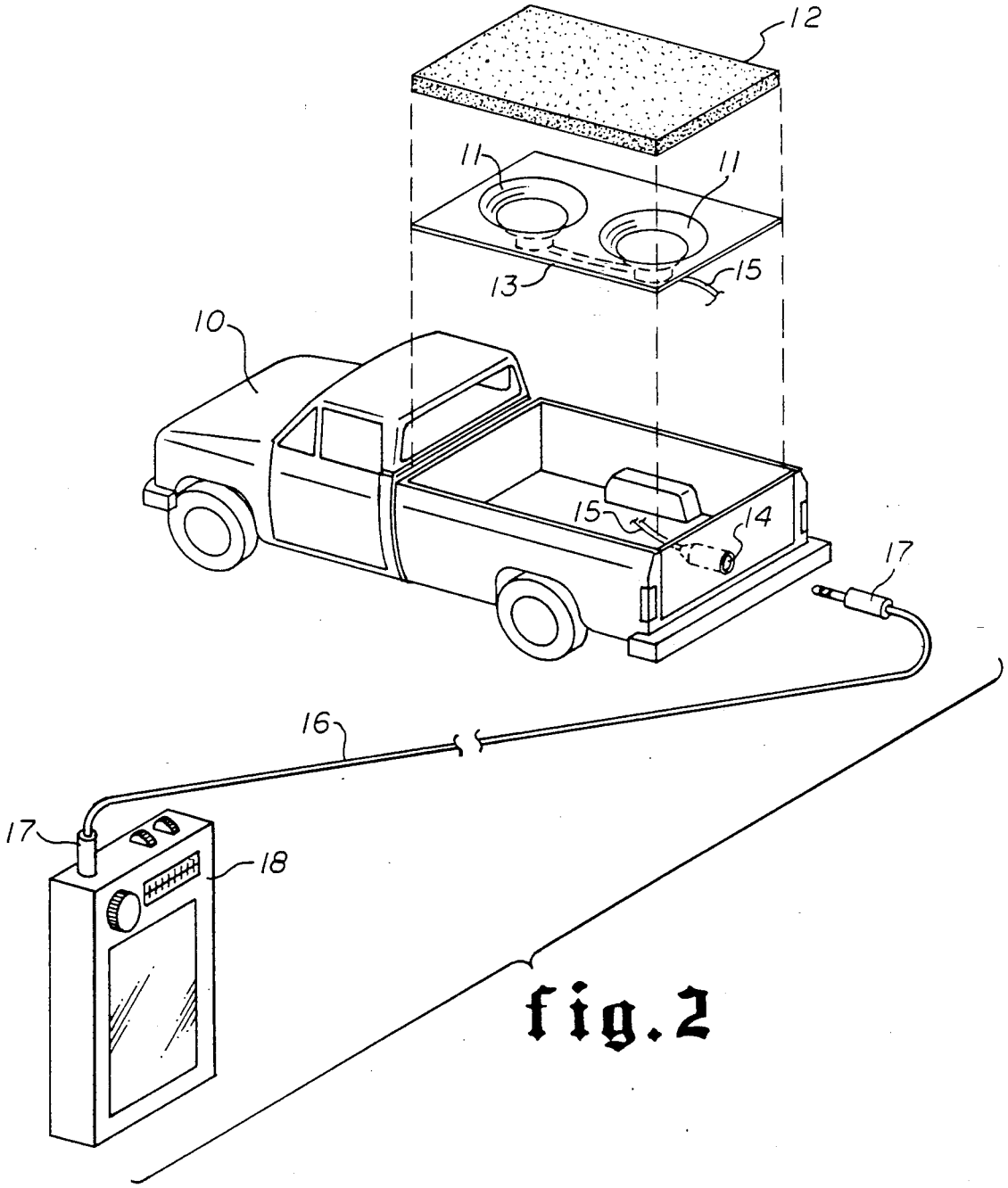
FIG. 2 is an exlpoded isometric view of the toy vehicle of FIG. 1.
Figure 3:
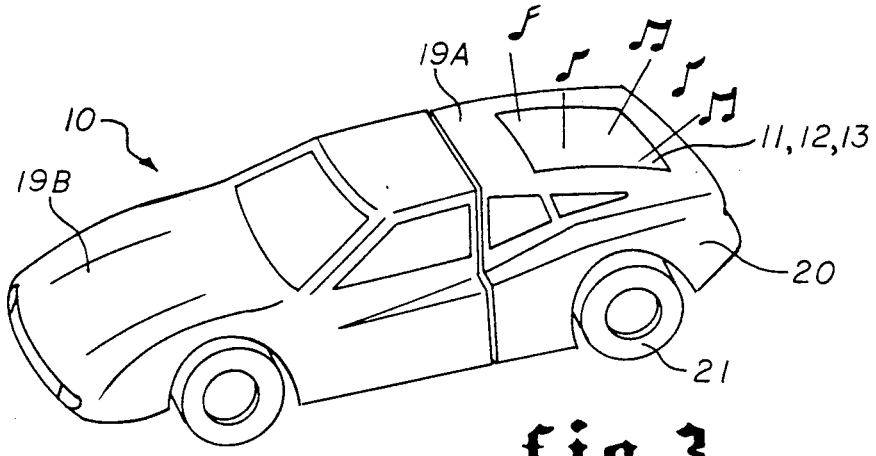
FIG. 3 is a perspective view of a toy vehicle in the form of an automobile having a sound system.

Referring to the drawings by numerals of reference, there is shown in FIGS. 1–4, a toy vehicle 10 having a sound system shown FIG. 1 in the form of a pickup truck and in FIG. 3 in the form of an automobile. One or more small loudspeakers 11 are secured to the body of the toy vehicle by conventional means such as screws, sonic welding or epoxy. The loudspeakers 11 may be covered with a protective speaker cover 12 to prevent them from becoming accidentally damaged. The speaker cover 12 may be formed of conventional speaker cover materials or may be a solid member to baffle the sound produced through the loudspeakers. Depending upon the size and type of toy vehicle, one or more loudspeakers 11 may be secured to a speaker mounting plate 13 which is then installed on or in the body of the toy vehicle.

It should be understood that the body of the toy vehicle may take any shape (i.e. truck, automobile, aircraft, etc.). It should also be understood that the toy vehicle with sound system described herein may be self propelled or remote controlled vehicles.

The loudspeakers 11 are sized to preferably fit within the toy vehicle body where they are hidden from view. Should the toy vehicle be a small micro miniature vehicle, one or more miniature loudspeakers of the type used in portable lightweight headphones or tiny earphone loudspeakers of the type which fit into a listener's outer ear can be used.

A mini-jack 14 is secured to the body of the toy vehicle 10 and connected by wire leads 15 to the loudspeakers 11. The wire leads 15 are preferably hidden from view with only the rear female portion of the mini-jack 14 visible.

An audio cable 16 having a male mini-plug 17 at one end is removably plugged into the mini-jack 14 and its other end connected to a sound source, such as a conventional portable radio and/or tape player 18. A preferred audio cable 16 has a male plug 17 at each end since most conventional portable radio and/or tape players are provided with a female headphone jack or receptacle to receive the mini-jack of a set of lightweight headphones. The portable radio and/or tape player 18, or other sound source, may be clipped to the belt or clothing of the child or placed on the floor in close proximity to the toy vehicle.

Thus, the toy vehicle 10 may be connected to an existing sound source such as a portable radio and/or tape player to play actual radio transmissions or prerecorded audio tapes. The toy vehicle 10 will simulate the radio or tape player of an actual vehicle and allows a child to select virtually any type of music or recorded sounds to be reproduced on the vehicle sound system. The vehicle sound system will allow the toy vehicle to simulate the currently popular "Boom Cars" having elaborate sound systems which the drivers play loudly to attract attention.

One or more audio cassettes (not shown) may also be provided with the toy vehicle 10. The toy vehicle can be played with as an ordinary toy vehicle while reproducing sounds or the mini-plug may be optionally disconnected from the vehicle body during play. The portable radio and/or tape player 18 may be clipped to the belt or clothing of the child or placed on the floor in close proximity to the toy vehicle 10 so that the play value is not diminished by the toy vehicle being connected to the sound source by a cable.

The volume of the music or sounds being played may be selectively controlled by the volume control dial of the portable radio and/or tape player 18. Alternatively, a small amplifier with a control knob may be installed on the vehicle body to control the volume.

Figure 4:
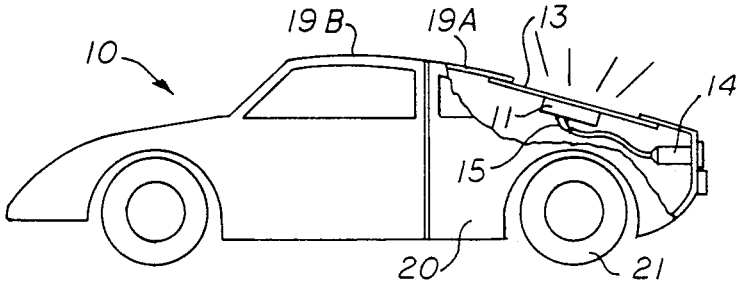
FIG. 4 is a side elevation of the toy vehicle of FIG. 3 shown in partial cross section to illustrate the vehicle sound system.
Figure 5:
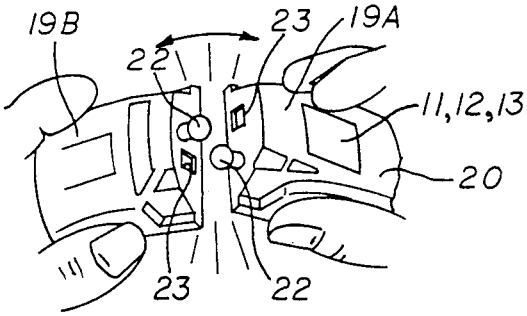
FIG. 5 is an illustration of the toy vehicle of FIG. 3 in modular form showing the connection between a rear sound system module and a vehicle front portion module.

As seen in FIGS. 4 and 5, the toy vehicle 10 with sound system may be provided in connectable modular form whereby the loudspeakers 11 are secured within a sound system module 19A which can be selectively connected to other vehicle components 19B to produce vehicles of various configurations and designs. The sound module 19A comprises a housing 20 configured to resemble the rear portion of a vehicle body and may be provided with wheels 21. A snap fit bead or other releasable connection 22 is provided on at least one end of the sound module 19A which releasably engages a mating fitting 23 on the forward vehicle portion or module 19B. Thus, the sound module 19A may be selectively connected to a variety of vehicle front end body configurations. The configuration of the sound module 19A may take any shape to compliment the forward vehicle portion 19B to form a truck, automobile, aircraft, etc.

Figure 7:
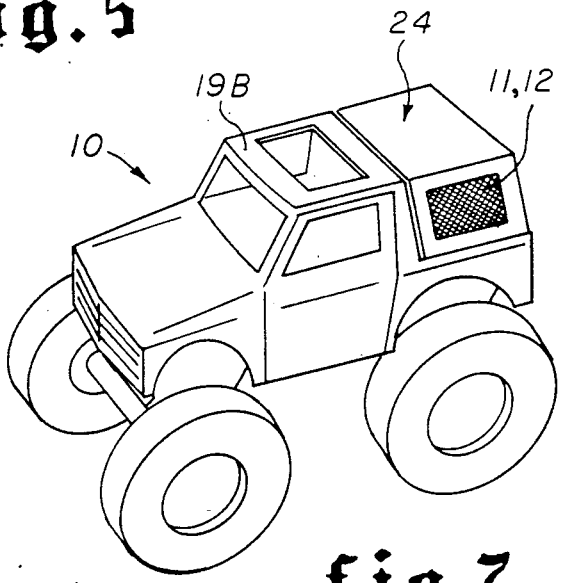
FIG. 7 is an illustration of the sound system module of FIG. 6 connected to a vehicle body.
Figure 6:
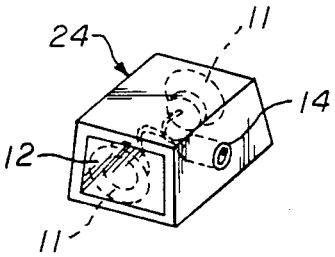
FIG. 6 is an illustration of another sound system module which may be selectively connected to toy vehicles.

FIGS. 6 and 7 show another connectable sound module 24 which can be selectively installed on an existing toy vehicle 25. This embodiment does not require modification of the vehicle and the sound module 24 may be purchased as a stand alone item and then connected to various existing vehicles. For example, the illustrated sound module 24 is configured to be received in the bed of a truck or jeep type vehicle and resembles a camper top.

One or more small loudspeakers 11 are secured within the sound module 19A or 24 by conventional means such as screws, sonic welding or epoxy. The loudspeakers 11 may be covered with a protective speaker cover 12 to prevent them from becoming accidentally damaged or a solid cover member may be used to baffle the sound produced through the loudspeakers. Depending upon the size and style of the sound module 19A or 24, one or more loudspeakers 11 may be secured to a speaker mounting plate 13 which is then installed in the sound module of the toy vehicle (FIG. 4). Should the sound module 19A be in a miniature scale, one or more miniature loudspeakers of the type used in portable lightweight headphones or tiny loudspeakers of the type which fit into a listener's outer ear can be used.

A mini-jack 14 is secured to the body of the sound module 19A or 24 and connected by wire leads 15 to the loudspeakers 11. The wire leads 15 are preferably hidden from view with only the rear female portion of the mini-jack 14 visible. As previously described, an audio cable having a mini-plug at one end may be plugged into the mini-jack 14 and its other end connected to a conventional portable radio and/or tape player.

OPERATION

To use the toy vehicle with sound system, the user plugs the male mini-plug 17 at one end of the audio cable 16 into the mini-jack 14 on the body of the vehicle 10 or the sound module 19A or 24, and the mini-plug at the other end of the cable into the female headphone jack or receptacle on a conventional portable radio and/or tape player 18. The portable radio and/or tape player 18 may be clipped to the belt o clothing of the child or placed on the floor in close proximity to the toy vehicle.

After the toy vehicle has been connected, the radio or tape player is turned on to play actual radio transmissions or prerecorded audio tapes. The toy vehicle will simulate the radio or tape player of an actual vehicle and allows a child to select virtually any type of music or recorded sounds to be reproduced on the vehicle sound system. One or more audio cassettes may also be provided with the toy vehicle to simulate various sounds. The toy vehicle can be played with as an ordinary toy vehicle while reproducing sounds or the mini-plug may be optionally disconnected from the vehicle body during play. The volume of the music or sounds being played may be selectively controlled by the volume control dial of the portable radio and/or tape player.

While this invention has been described fully and completely with special emphasis upon several preferred embodiments, it should be understood that within the scope of the appended claims the invention may be practiced otherwise than as specifically described herein.

I claim:

1. A toy vehicle having a remotely driven sound system releasably connectable to a sound source for reproducing sounds through the vehicle sound system comprising;

a toy vehicle having a body, one or more small loudspeakers housed within said vehicle body and substantially hidden from view, an audio jack on said vehicle body coupled with said loudspeakers to releasably connect said loudspeakers to a remote radio or tape player, whereby said toy vehicle when connected to the remote radio or tape player will reproduce actual radio transmissions or prerecorded audio tapes to closely simulate the radio or tape player of an actual vehicle and allow the selection of various types of music or recorded sounds to be reproduced on the vehicle sound system.

2. A toy vehicle according to claim 1 in which said radio or tape player is a small portable radio or tape player which may be worn on the body of the person playing with the toy vehicle or placed in a convenient location a distance from the toy vehicle.

3. A toy vehicle according to claim 1 in which said loudspeakers are covered with a protective speaker cover to prevent them from becoming accidentally damaged.

4. A toy vehicle according to claim 1 in which said loudspeakers are covered with a generally solid cover prevent them from becoming accidentally damaged and to baffle the sound produced through the loudspeakers.

5. A toy vehicle according to claim 1 including an audio cable adapted to be connected at one end to said audio jack on said toy vehicle body and at its other end to said remote radio or tape player.

6. A toy vehicle according to claim 1 in which said vehicle body is segmented into connectable body modules including a sound system module having a housing configured to resemble a portion of a vehicle and at least one other body module resembling another portion of a vehicle.

said sound system module and said other body module having mating releasable connections whereby they may be selectively connected together to produce vehicles of various configurations and designs, and said loudspeakers are housed within said sound system module and said audio jack is secured on said sound system module and coupled with said loudspeakers to releasably connect said sound system module to said remote radio or tape player.

7. A remotely driven sound system module for connection to toy vehicles comprising;

a remotely driven sound system module having a housing configured to resemble a portion of a toy vehicle and confured to be selectively connected to and disconnected from the toy vehicle, one or more small loudspeakers housed within said sound system module, an audio jack on said sound system module coupled with said loudspeakers to releasably connect said loudspeakers to a remote radio or tape player, whereby said sound system module when connected to the toy vehicle and to the remote radio or tape player will reproduce actual radio transmissions or prerecorded audio tapes to closely simulate the radio or tape player of an actual vehicle and allow the selection of various types of music or recorded sounds to be reproduced on the vehicle sound system module.

8. A remotely driven sound system module according to claim 7 including a portable radio or tape player releasably connected to said sound system module for driving said loudspeakers and adapted to be worn remote from said sound system module on the body of the person playing with the toy vehicle or placed in a convenient location a distance from the toy vehicle, and cable means adapted to be connected at one end to said audio jack on said sound system module and at its other end to said portable radio or tape player.

9. The combination of a portable radio or tape player with a toy vehicle;

said toy vehicle having a body containing one or more small loudspeakers and an audio jack mounted on said body and coupled with said loudspeakers for releasably connecting said loudspeakers to the portable radio or tape player, audio cable means connectable at one end to said audio jack and at its other end to said portable radio or tape player, such that said loudspeakers contained in said toy vehicle when connected to the radio and/or tape player will be driven thereby to reproduce actual radio transmissions or prerecorded audio tapes to closely simulate the radio or tape player of an actual vehicle and allow a child to select various types of music or recorded sounds to be reproduced through the vehicle loudspeakers.

10. The combination according to claim 9 in which said vehicle body is segmented into connectable body modules including a sound system module having a housing configured to resemble a portion of a vehicle and at least one other body module resembling another portion of a vehicle, said sound system module and said other body module having mating releasable connections whereby they may be selectively connected together to produce vehicles of various configurations and designs, and said loudspeakers are housed within said sound module and said audio jack is secured on said sound module and coupled with said loudspeakers to releasably connect said sound system module to the portable radio or tape player.

* * * * *